United States Patent [19]

Terauchi et al.

[11] Patent Number: 4,547,137

[45] Date of Patent: Oct. 15, 1985

[54] SCROLL TYPE FLUID COMPRESSOR WITH THICKENED SPIRAL ELEMENTS

[75] Inventors: Kiyoshi Terauchi, Isesaki; Masaharu Hiraga, Honjo, both of Japan

[73] Assignee: Sanden Corporation, Isesaki, Japan

[21] Appl. No.: 535,848

[22] Filed: Sep. 26, 1983

[30] Foreign Application Priority Data

Sep. 26, 1982 [JP] Japan ..... 57-167063

[51] Int. Cl.[4] ..... F04C 18/04

[52] U.S. Cl. ..... 418/55

[58] Field of Search ..... 418/55

[56] References Cited

U.S. PATENT DOCUMENTS 3,473,728 10/1969 Vulliez ..... 418/55
3,802,809 4/1974 Vulliez ..... 418/5
3,874,827 4/1975 Young ..... 418/55
4,382,754 5/1983 Shaffer et al. ..... 418/55

FOREIGN PATENT DOCUMENTS 57-148088 9/1982 Japan ..... 418/55

*Primary Examiner*—John J. Vrablik
*Attorney, Agent, or Firm*—Banner, Birch, McKie & Beckett

[57] ABSTRACT

A scroll type compressor has interfitting spiral elements with thickened inner end portions which are stronger than the inner end portions of conventional spirals, and minimize the re-expansion volume of the working fluid. The inner end portions are comprised of arcuate surfaces which deviate from the involute curves of the remainder of the spiral elements.

8 Claims, 24 Drawing Figures

FIG. Ig
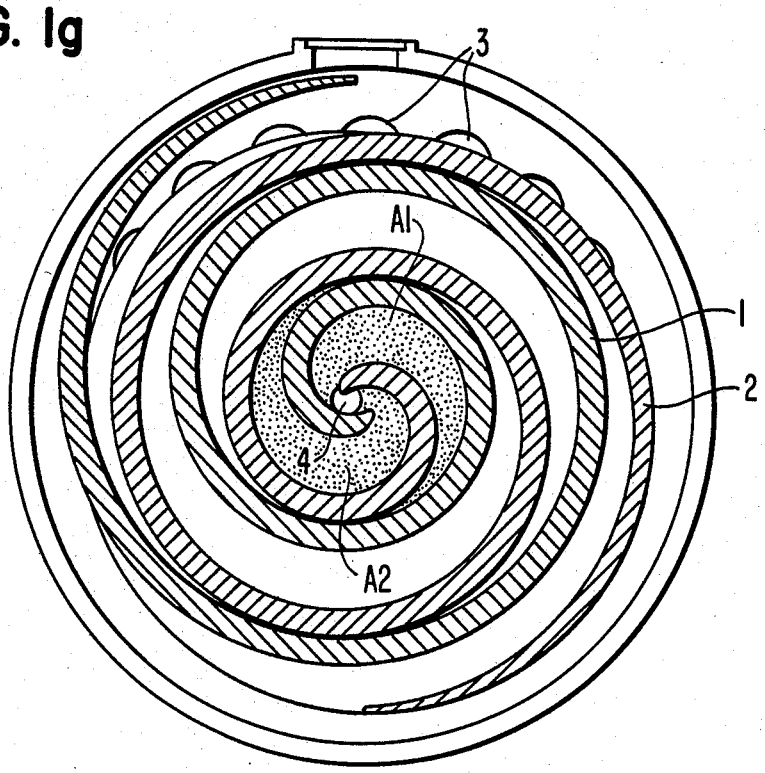
FIG. Ih
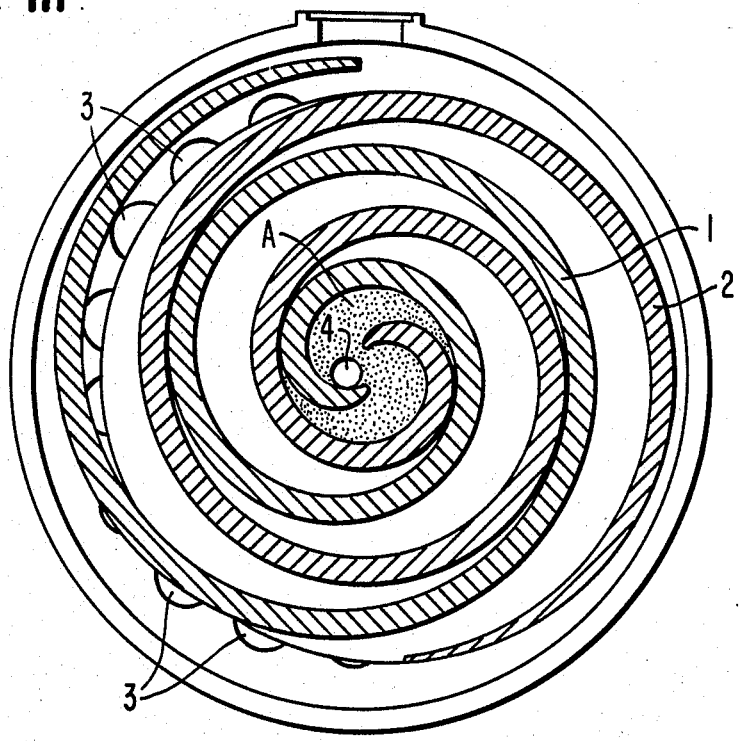

SCROLL TYPE FLUID COMPRESSOR WITH THICKENED SPIRAL ELEMENTS

BACKGROUND OF THE INVENTION

This invention relates to a fluid displacement apparatus and, more particularly, to a scroll type compressor having improved spiral elements on its scroll members.

Scroll type fluid displacement apparatus are well-known in the prior art. For example, U.S. Pat. No. 801,182 to Cruex discloses a scroll type apparatus including two scroll members each having a circular end plate and a spiroidal or involute spiral element. These scroll members are maintained at an angular and radial offset so that both spiral elements interfit to make a plurality of line contacts between their spiral curved surfaces to thereby seal off and define at lest one pair of fluid pockets. The relative orbital motion of the two scroll members shifts the line contacts along the spiral curved surfaces and, therefore, the fluid pockets change in volume. Since the volume of the fluid pockets increases or decreases, depending on the direction of the orbital motion, the scroll type fluid displacement apparatus is applicable to compress, expand or pump fluids.

Referring to FIGS. 1*a*–1*l* and FIG. 2, the general operation of a typical scroll type compressor will be described. FIGS. 1*a*–1*l* schematically illustrate the relative movement of interfitting spiral elements to compress the fluid. FIG. 2 diagrammatically illustrates the compression cycle in each of the fluid pockets.

Two spiral elements 1 and 2 are angularly and radially offset and interfit with one another. FIG. 1*a* shows that the outer terminal end of each spiral element is in contact with the other spiral element, i.e., suction through suction ports 3 just has been completed, and a symmetrical pair of fluid pockets A1 and A2 just have been formed.

Each of FIGS. 1*b*–1*l* shows the state of the scroll members at a drive shaft crank angle which is advanced 90° from the state shown in the preceding figure. Throughout the states shown in FIGS. 1*a*–1*f*, the pair of fluid pockets A1 and A2 shift angularly and radially towards the center of the interfitting spiral elements with the volume of each fluid pocket A1 and A2 being gradually reduced. Fluid pockets A1 and A2 are connected to one another in passing from the state shown in FIG. 1*f* to the state shown in FIG. 1*g* and, as shown in FIG. 1*i*, both pockets A1 and A2 merge at the center portion A and are completely connected to one another to form a single pocket. The volume of the connected single pocket is further reduced by a drive shaft revolution of 90° as shown in FIGS. 1*i*–1*k*. During the course of relative orbital movement, outer spaces which are open in the state shown in FIG. 1*b* change as shown in FIGS. 1*c* and 1*d* to form new sealed off fluid pockets in which fluid is newly enclosed (FIG. 1*e* shows this state).

Referring to FIG. 2, the compression cycle of fluid in one fluid pocket will be described. FIG. 2 shows the relationship of fluid pressure in the fluid pocket to crank angle, and shows that one compression cycle is almost completed at a crank angle of $5\pi$, in this case.

The compression cycle begins (FIG. 1*a*) when the fluid pockets are sealed, i.e., the outer end of each spiral element is in contact with the opposite spiral element, the suction phase having finished. This state of fluid pressure in a fluid pocket is shown at point H in FIG. 2. The volume of the fluid pocket is reduced and fluid is compressed by the revolution of the orbiting scroll until the crank angle reaches approximately $3\pi$, which state is shown by point L in FIG. 2. Immediately after passing this state and, hence, passing point L, the pair of fluid pockets are connected to one another and simultaneously are connected to the space filled with high pressure fluid, which is left undischarged at the center of both spiral elements. At this time, if the compressor is not provided with a discharge valve in discharge port 4, the fluid pressure in the connected fluid pockets suddenly rises to equal the pressure in the discharge chamber. If, however, the compressor is provided with a discharge valve, such as a reed valve which will open at a predetermined discharge pressure, the fluid pressure in the connected fluid pockets rises only slightly due to mixing of the high pressure fluid and the fluid in the connected fluid pockets. This state is shown at point M in FIG. 2. The fluid in the high pressure space is further compressed by orbital motion of the orbiting scroll until it reaches the discharge pressure. This state is shown at point N in FIG. 2. When the fluid in the high pressure space reaches the discharge pressure, the fluid is discharged to the discharge chamber through the discharge port by the automatic operation of the reed valve. Therefore, the fluid in the high pressure space is maintained at the discharge pressure until a crank angle of approximately $5\pi$ (point A in FIG. 2) is reached. Accordingly, one cycle of the compressor is completed at a crank angle of $5\pi$, but the next cycle begins at the mid-point of compression of the fluid cycle as shown by the dashed lines in FIG. 2. Therefore, fluid compression proceeds continuously by the operation of these cycles.

In this type of scroll compressor, the wall thickness of each spiral element from its outer terminal end to its inner end is uniform. Generally, the wall thickness of each spiral element will be designed as a predetermined minimum thickness required for spiral strength, since the largest possible fluid volume must be accommodated within the predetermined diameter of the compressor housing. The various factors affecting spiral element strength must be considered in scroll member design. During the operation of the compressor, for example, the spiral elements, which define the sealed off fluid pockets, are subjected to cyclical changes of fluid pressure, which may cause fatigue rupture of the spiral elements. The inner end portion of the spiral element—the terminal portion located at the high pressure space—is especially vulnerable to fatigue because it can flex more easily than a central portion of the spiral. The central portion itself is vulnerable in the case of a lengthened spiral element (formed longer to obtain a large compressor displacement) because of reduced spiral rigidity. The spiral element can be strengthened by uniformly increasing the wall thickness, but if the displacement of the compressor is to be kept the same, the dimensions of the casing must be increased, resulting in a larger and heavier compressor.

Generally, an end milling tool is used for forming the spiral element on the scroll member. Such a milling tool must have a certain minimum diameter in order to be rigid enough so that fine finishing of the spiral element can be carried out. A sufficiently rigid tool, however, has a diameter which is too large to permit the milling of the inner side wall of the spiral (at the inner end thereof) in a shape which properly follows the desired involute curve and properly intersects the involute generating circle. An undesirable arc-shaped configuration results on the inner side wall of the inner end portion of the spiral element, having a radius which matches that of the milling tool.

During operation of a compressor which includes the above-configured spiral element, the line contacts defined between the involute curved surfaces of the spiral elements are dissolved when the line contacts reach the inner end portion of the spiral elements which have the undesirable arcuate configuration. At this time, the central high pressure pocket within which high pressure fluid remains is connected to the adjacent pair of fluid pockets. Therefore, the high pressure fluid within the high pressure pocket is partially re-expanded, resulting in a loss of power and a reduction of efficiency.

SUMMARY OF THE INVENTION

It is a primary object of this invention to provide an improved compressor wherein endurance is improved due to a strengthened configuration of the inner end portion of each spiral element.

It is another object of this invention to provide an efficient scroll type compressor wherein re-expansion of the compressed fluid is minimized and, hence, power loss of the compressor is reduced.

It is still another object of this invention to realize the above objects with simply constructed and light weight compressor.

A scroll type compressor according to this invention includes a housing having a fluid inlet port and a fluid outlet port. A fixed scroll is fixedly disposed relative to the housing and has an end plate from which a first spiral wrap extends axially into the interior of the housing. An orbiting scroll is movably disposed for non-rotative orbital movement within the interior of the housing and has an end plate from which a second spiral wrap extends. The first and second wraps interfit at an angular and radial offset to make a plurality of line contacts to define at least one pair of sealed off fluid pockets. Drive means is operatively connected with the orbiting scroll to effect the orbital motion of the orbiting scroll while preventing the rotation of the orbiting scroll, thus causing the fluid pockets to change volume due to the orbital motion of the orbiting scroll. The outer and inner side wall surfaces of both wraps are defined by involute curves. The involute outer side wall surface starts from an arbitrary involute angle, and the involute inner side wall surface starts from an involute angle which is 180° greater than the arbitrary involute angle. The starting points of the involute side wall surfaces are interconnected by an inner end surface comprised of at least two arcuate surfaces to form a thicker inner end portion of the wrap.

Further objects, features and other aspects of this invention will be understood from the following detailed description of preferred embodiments of this invention, while referring to the annexed drawings.

BRIEF DESCRIPTION OF THE DRAWINGS

FIGS. 1*a*–1*l* are schematic views illustrating the relative movement of interfitting spiral elements to compress fluid.

DETAILED DESCRIPTION OF THE PREFERRED EMBODIMENTS

Figure 3:
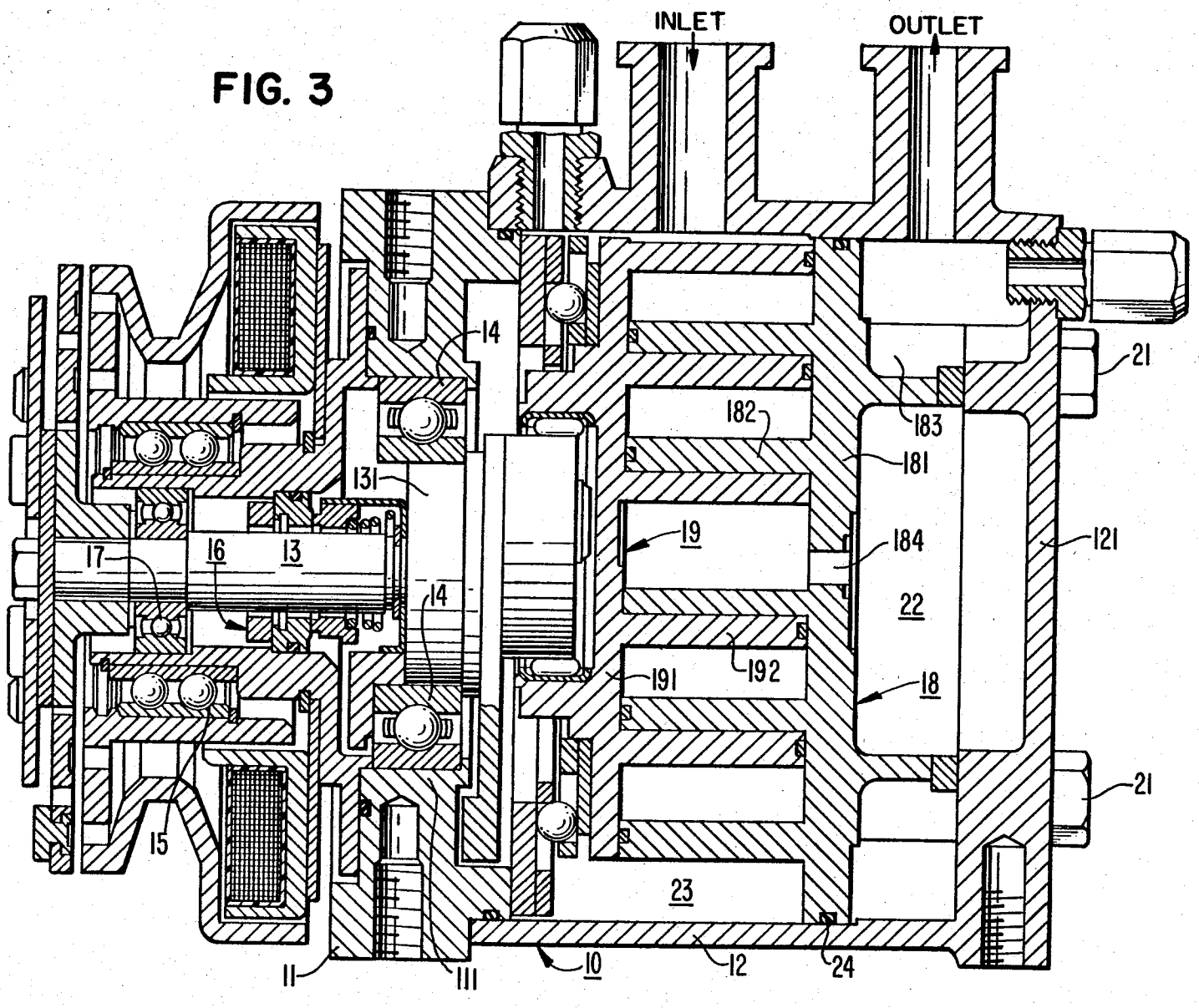
FIG. 3 is a vertical sectional view of a compressor unit according to one embodiment of this invention.

Referring to FIG. 3, a scroll type fluid (e.g., refrigerant) compressor in accordance with the present invention is shown. The compressor unit includes compressor housing 10 having a front end plate 11 and cup-shaped casing 12 which is attached to an end surface of front end plate 11. An opening 111 is formed in the center of front end plate 11 for penetration or passage of drive shaft 13. Cup-shaped casing 12 is fixed on the inside surface of front end plate 11 by fastening devices, for example bolts and nuts (not shown), so that the opening of cup-shaped casing 12 is covered by front end plate 11.

Front end plate 11 has an annular sleeve 15 projecting from the front end surface thereof. This sleeve 15 surrounds drive shaft 13 to define a shaft seal cavity. A shaft seal assembly 16 is assembled on drive shaft 13 within the shaft seal cavity. Drive shaft 13 is formed with a disk-shaped rotor 131 at its inner end portion. Disk shaped rotor 131 is rotatably supported by front end plate 11 through a bearing 14 located within opening 111 of front end plate 11. Drive shaft 13 is also rotatably supported by sleeve 15 through a bearing 17.

The outer end of drive shaft 13 which extends from sleeve 15 is connected to a rotation transmitting device, for example, an electromagnetic clutch which may be disposed on the outer peripheral surface of sleeve 15 for transmitting rotary movement to drive shaft 13. Thus, drive shaft 13 is driven by an external power source, for example, the engine of a vehicle, through the rotation transmitting device.

A number of elements are located within the inner chamber of cup-shaped casing 12 including a fixed scroll 18, an orbiting scroll 19, a driving mechanism for orbiting scroll 19 and a rotation preventing/thrust bearing device 20 for orbiting scroll 19 formed between the inner wall of cup-shaped casing 12 and the rear end surface of front end plate 11.

Fixed scroll 18 includes circular end plate 181, wrap or spiral element 182 affixed to and extending from one end surface of circular end plate 181 and a plurality of internally threaded bosses 183 axially projecting from the outer end surface of circular end plate 181. The axial end surface of each boss 183 is seated on the inner surface of an end plate 121 of cup-shaped casing 12 and fixed by bolts 21, thus fixing scroll 18 within cup-shaped casing 12. Circular end plate 181 partitions the inner chamber of cup-shaped casing 12 into two chambers: a discharge chamber 22 and a suction chamber 23. A seal ring 24 is located between the outer peripheral surface of end plate 181 and the inner wall of cup-shaped casing 12 to seal off and define the two chambers. A hole or discharge port 184 which interconnects the center portions of the scrolls with discharge chamber 22 is formed through circular end plate 181.

Orbiting scroll 19 also includes a circular end plate 191 and a wrap or spiral element 192 affixed to and extending from one side surface of circular end plate 191. Spiral element 192 of orbiting scroll 19 and spiral element 182 of fixed scroll interfit at an angular offset of 180° and predetermined radial offset. At least a pair of sealed off fluid pockets are thereby defined between both spiral elements 182, 192. Orbiting scroll 19, which is connected to the driving mechanism and to the rotation preventing/thrust bearing device 20, is driven in an orbital motion at a circular radius ($r_o$) by rotation of drive shaft 13 to thereby compress fluid passing through the compressor unit, according to the general principles described above.

Figure 4:
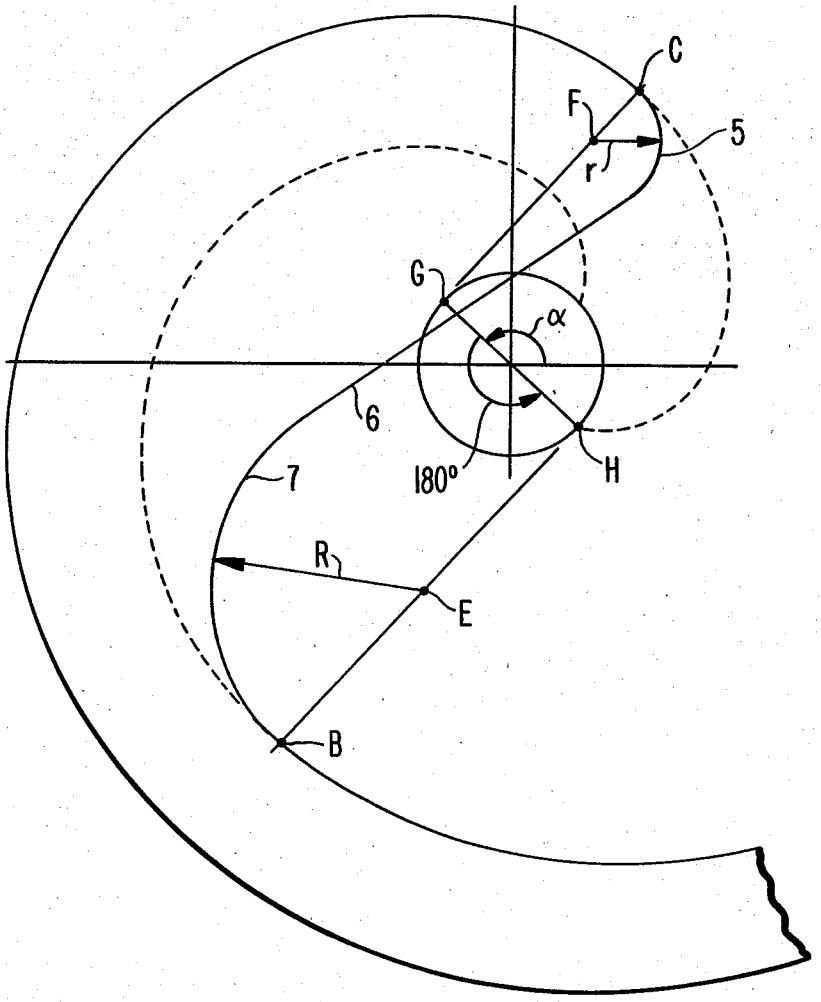
FIG. 4 is an enlarged view of a portion of a spiral element illustrating the configuration of the inner end portion of the spiral element in accordance with one embodiment of the invention.

Referring to FIG. 4, the configuration of the scroll members according to this invention, particularly the configuration of the inner end portions of the spiral elements, will be described in more detail. The configurations of the two spiral elements are essentially identical, except that, of course, one is essentially the mirror image of the other. The dashed lines represent the general configuration of the inner end portion of a prior art spiral element.

In the description that follows, angle "$\alpha$" is an arbitrary involute angle, "G" is a point located on the involute generating circle corresponding to involute angle $\alpha$, and "H" is a point located on the involute generating circle corresponding to involute angle $\alpha+180°$.

The outer and inner side walls of the spiral elements are generally formed by involute curves. The involute curve which forms the outer side wall of the spiral element starts from point C. This point C is located at the intersection of the involute curve and the line tangent to the involute generating circle through point G.

The involute curve which forms the inner side wall of the spiral element starts from point B. This point B is located at the intersection of the involute curve and the line tangent to the involute generating circle through point H.

The configuration of the inner end portion of the spiral element, i.e., the configuration between points B and C, is determined as follows. At first, an arbitrary point F is set on the tangent line $\overline{GC}$, and arc 5 of radius $r=\overline{FC}$ is struck around the point F. Also, an arbitrary point E is set on the tangent line $\overline{HB}$, and arc 7 is struck around point E of radius $R=EB=r+r_o$, where $r_o$ is the orbital radius of the orbiting scroll. A tangent line 6 which is a common tangent of both arcs 5 and 7 is drawn to connect these arcs and complete the inner end portion. Thus, the inner and outer side walls of the spiral element are connected by two arcs and a straight line, i.e., the inner end portion of the spiral element is formed by an arcuate surface 5 having a radius r, another arcuate surface 7 having a radius $r+r_o$, and a flat surface 6 which is tangent to both arcuate surfaces 5, 7.

Figure 10A:
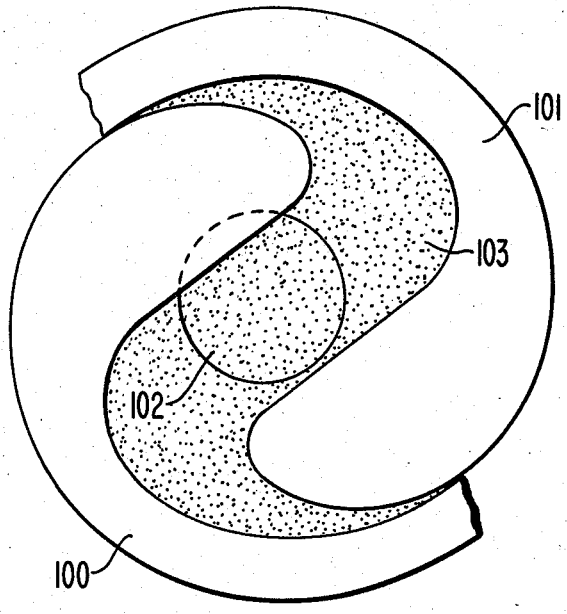
FIGS. 10*a*–10*d* are schematic views illustrating the discharge operation of the compressed fluid at the inner ends of the spiral elements.
Figure 10B:
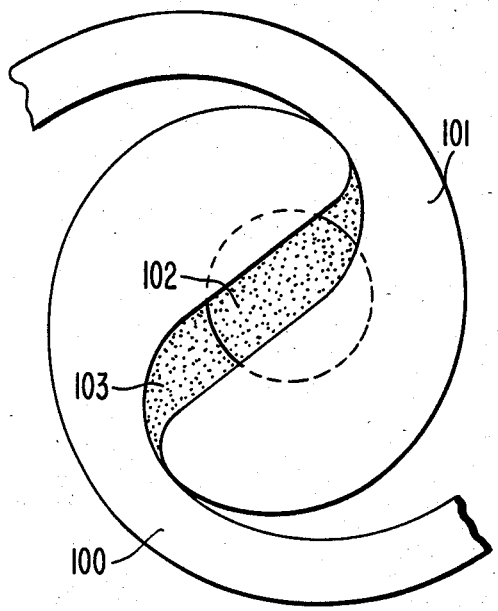
Figure 10C:
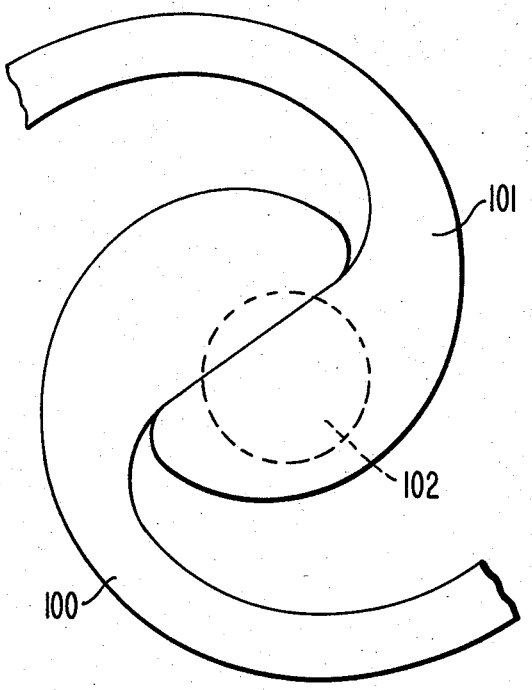
Figure 10D:
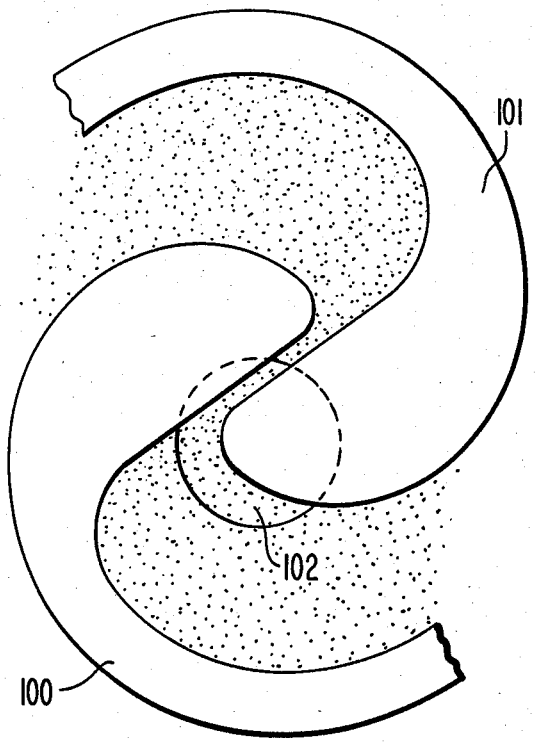

Referring to FIGS. 10*a*–10*d*, the principle of operation of interfitting spiral elements which have the above-described configuration now will be explained. FIG. 10*a* shows that a pair of sealed off fluid pockets which are defined between a fixed spiral element 100 and an orbiting spiral element 101 have merged and are connected with central high pressure space 103. Fluid within space 103 is continuously compressed during orbital motion of orbiting spiral element 101. When the pressure of fluid in space 103 reaches the discharge pressure, fluid within space 103 is discharged through discharge port 102 due to the relative orbital motion. In FIG. 10*b*, discharge of compressed fluid is continued. During the operation of the compression cycle up to the stage shown in FIG. 10*b*, the line contacts formed between spiral elements 100, 101 to define the fluid pockets shift inwardly towards the center of the interfitting spiral elements along the involute curves. However, in the stages moving from FIG. 10*b* to FIG. 10*c*, the loci of these line contacts run off the involute curves, but the line contacts are continuously maintained by contact along the arcs 5, 7 (see FIG. 4). Thereafter, as shown in FIG. 10*c*, the line contacts become a straight line contact along common tangent lines 6. At this time, the volume of the central high pressure space 103 becomes approximately zero. When the common tangent lines contact each other, the crankshaft axis crosses the tangent lines. Further rotation of the crankshaft separates the tangent lines, as shown in FIG. 10*d*, and the next pair of sealed off fluid pockets are thus connected with the central space 103.

As mentioned above, the line contacts between the spiral elements which define the sealed off fluid pockets can be continuously formed until one compression cycle is completed without interference between the spiral elements. Therefore, the volume of re-expansion can be reduced to improve the compression efficiency. Also, the thickness of the inner end portion of each spiral element is increased, so that the strength of the spiral element is improved.

Figure 5:
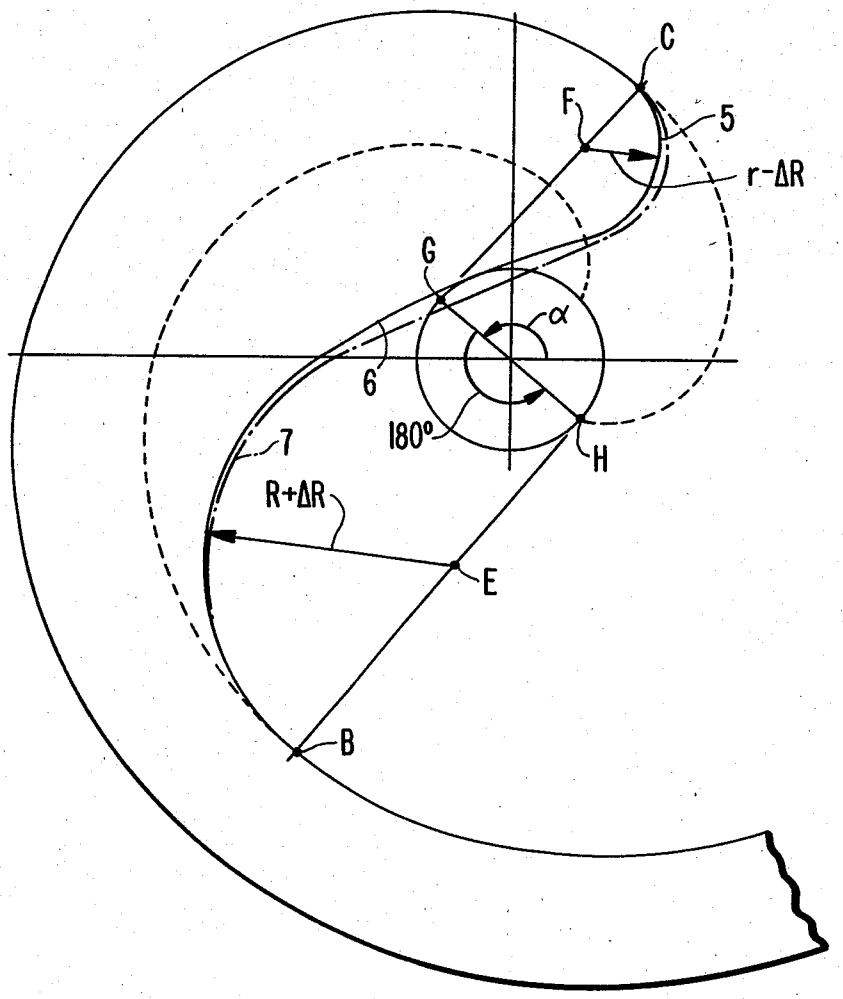
FIGS. 5–9 are enlarged views similar to FIG. 4, each of which shows another embodiment of this invention.

In this construction, as a result of possible misalignment of the angular relationship between both spiral elements which may occur during assembly of the compressor, or dimensional errors in the spiral elements which may occur during their manufacture, the enlarged inner end portions of both spiral elements may interfere with one another. To obviate this possibility, radius R of arc 7 can be slightly ($\Delta R$) increased, the radius r of arc 5 can be slightly ($\Delta R$) decreased, and an arbitrary line drawn to connect the two arcs, as shown in FIG. 5. (In FIG. 5, the former configuration illustrated in FIG. 4 is shown by dot-dash lines for comparison.)

Figure 6:
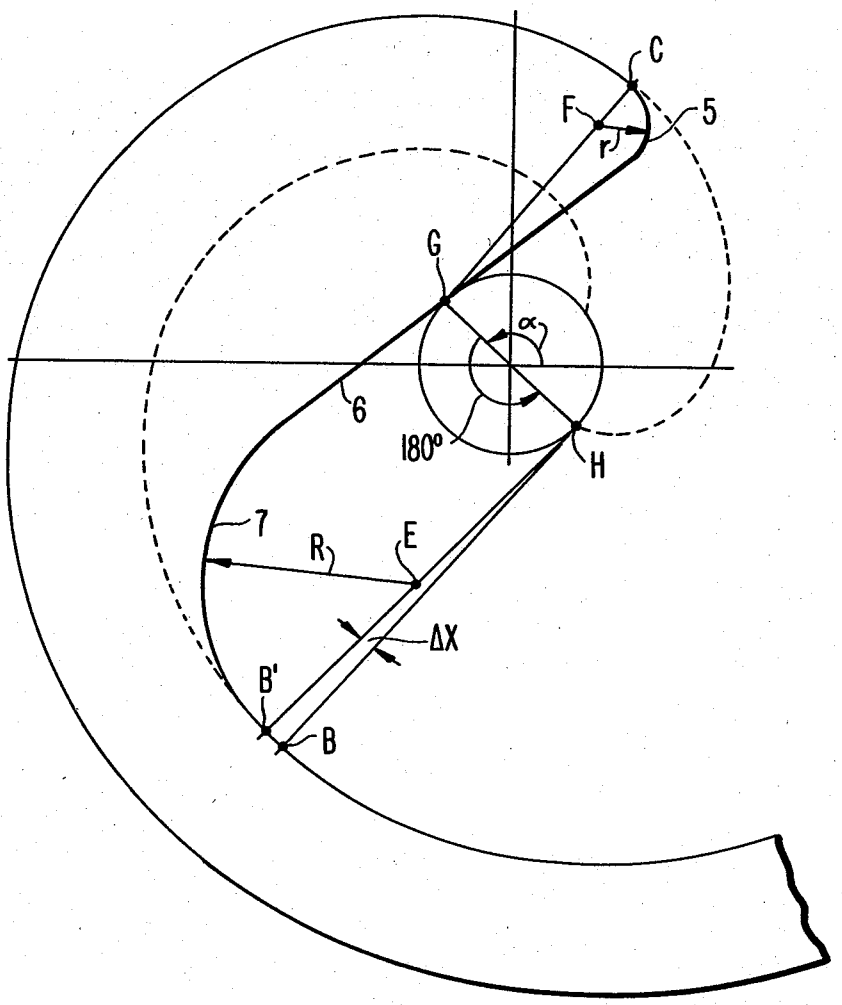

Referring to FIG. 6, another embodiment is shown. This embodiment is directed to a modification of the starting point of the involute curve which forms the inner side wall of the spiral element. In this embodiment, this curve is started at point B′, which is angularly offset by $\Delta x$ from point B.

Figure 7:
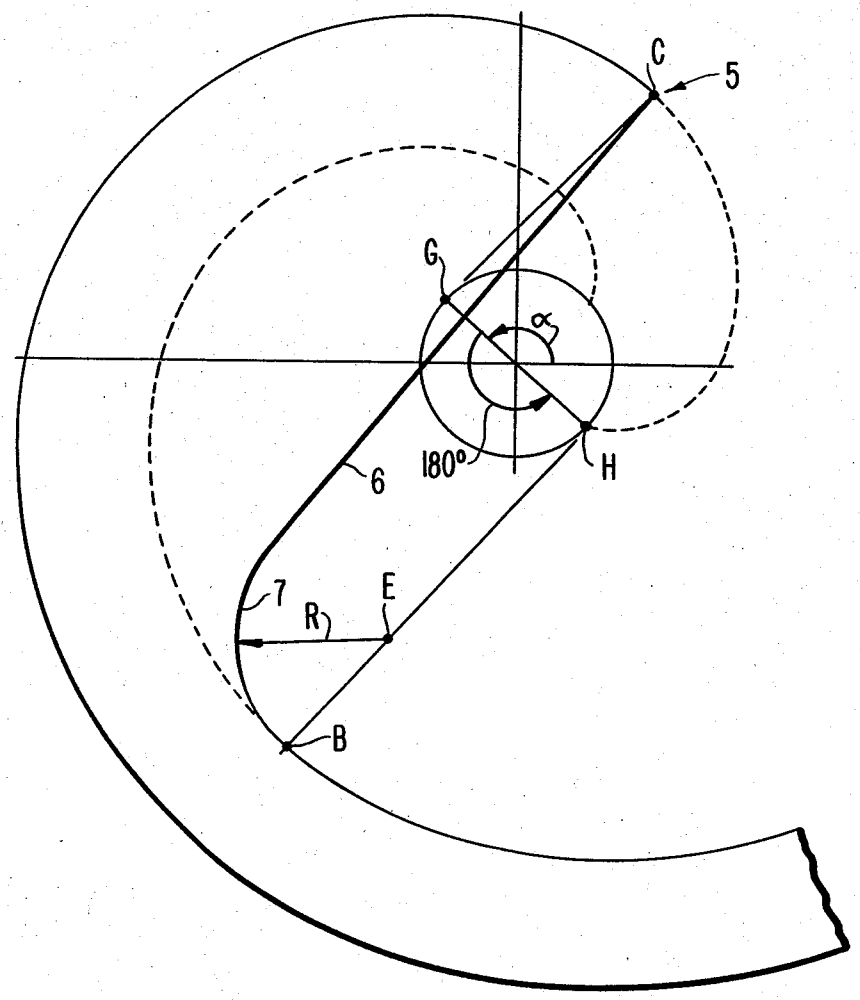

The relationship between the radii r and R of the two arcs 5, 7 must be maintained such that $R-r_o=r$ to obtain the above-described line contact advantage. Therefore, as shown in FIG. 7, if there is no arc from point C the inner end portion of the spiral element consists of one arc 7 of radius R and a straight line which connects point C and arc 7.

Figure 9:
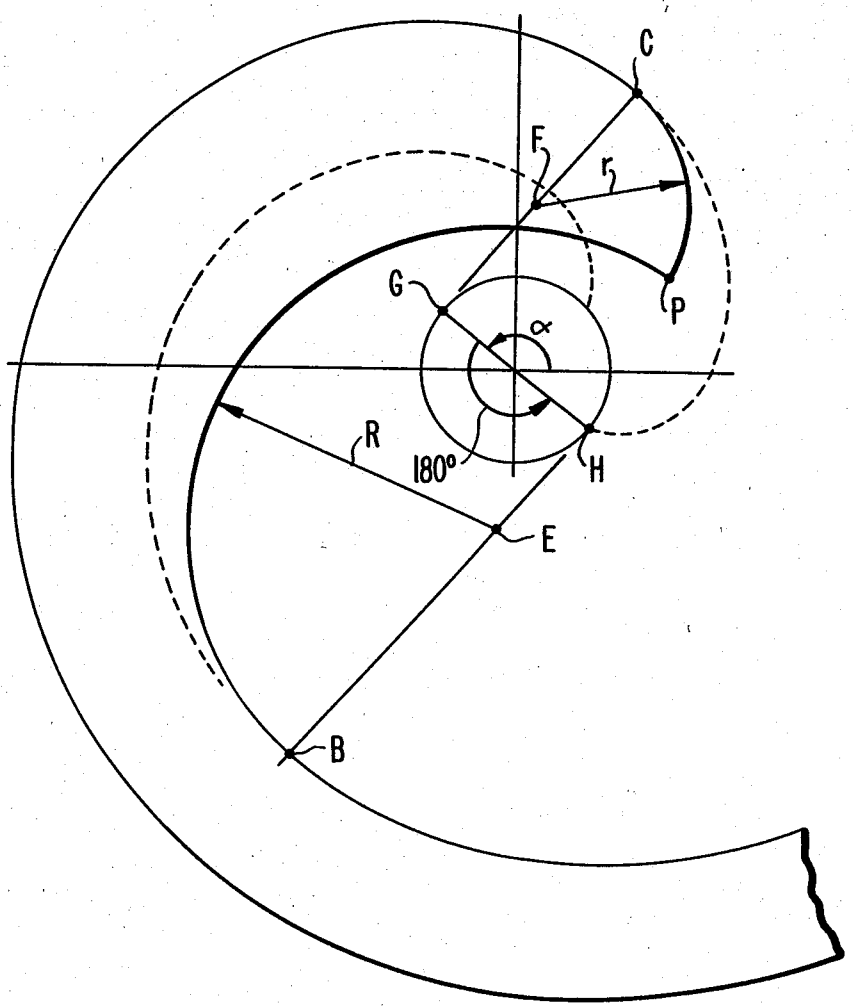
Figure 8:
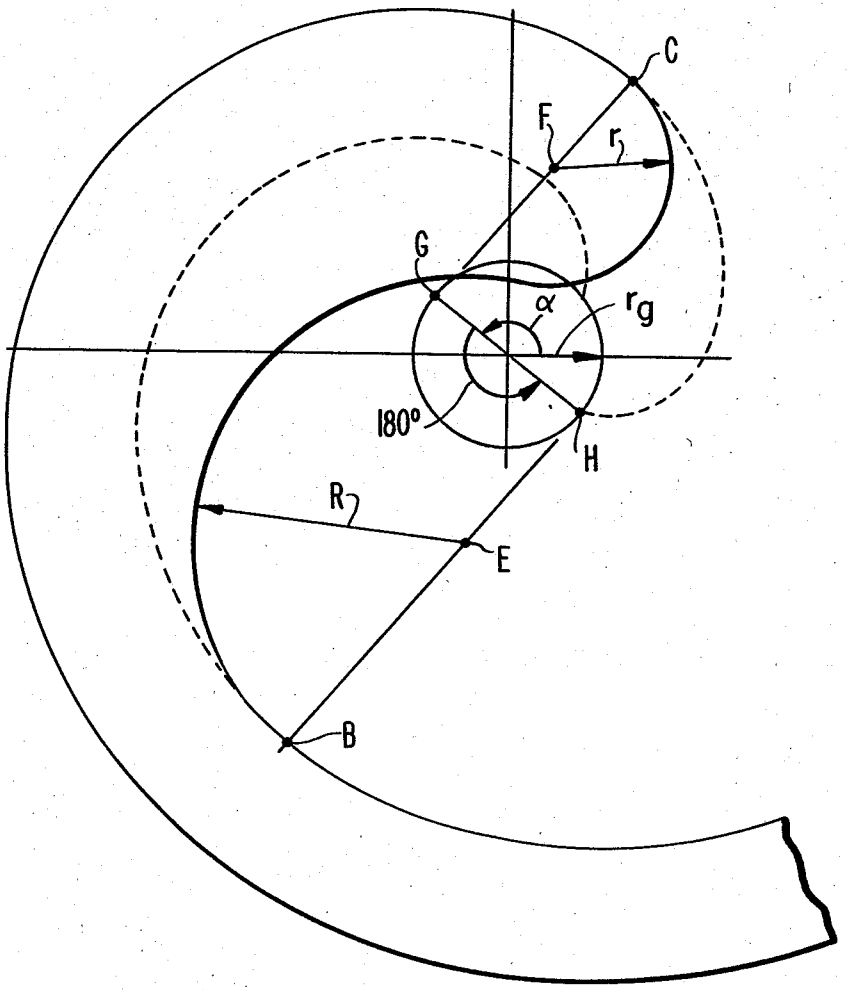

Referring to FIG. 8, still another embodiment is shown. This embodiment is directed to a modification of the inner side wall of the spiral element. In this embodiment, the distance between the two starting points B and C is connected only by two arcs. The radii r and R of the arcs are given by the following formulae:

$$R = \frac{(2r_g \cdot \alpha + \pi \cdot r_g - 2\beta \cdot r_g)^2 + (2r_g)^2}{4(2r_g \cdot \alpha + \pi \cdot r_g - 2\beta \cdot r_g)} + \frac{r_o}{2}$$

$$r = R - r_o$$

where $r_g$ is the radius of the involute generating circle and $\beta$ is the phase angle between the inner and outer side walls (wall thickness of the spiral element $=2\beta \cdot r_g$). In this construction, if radius R of one of the arcs is increased and this arc cuts the other arc of radius r, i.e., both arcs intersect at point P (this configuration is shown by FIG. 9), the line contacts between the two spiral elements are maintained until the line contacts reach point P. When the line contacts pass point P, the central high pressure space is connected to the next pair of fluid pockets. Therefore, the re-expansion volume is minimized.

Figure 1A:
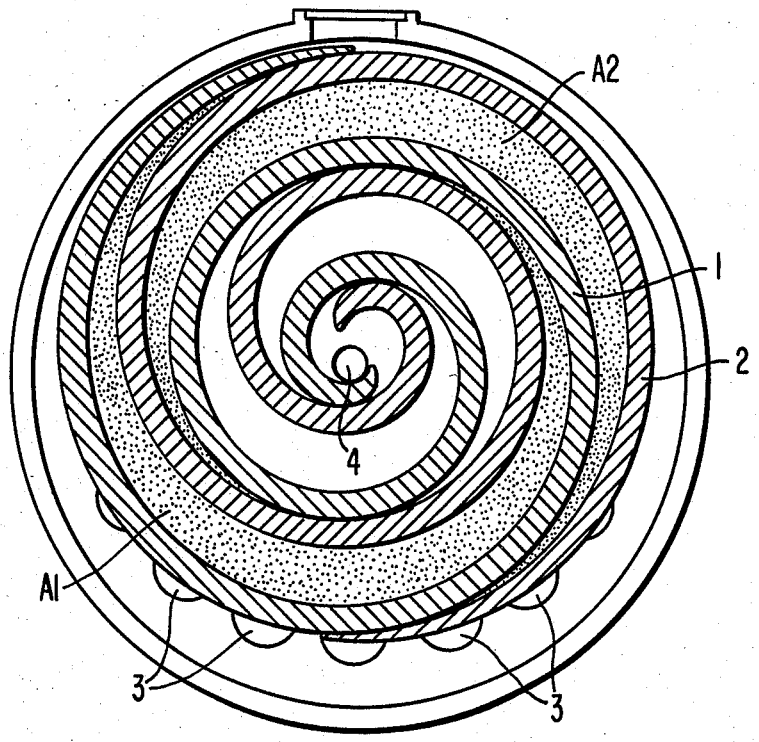
Figure 1B:
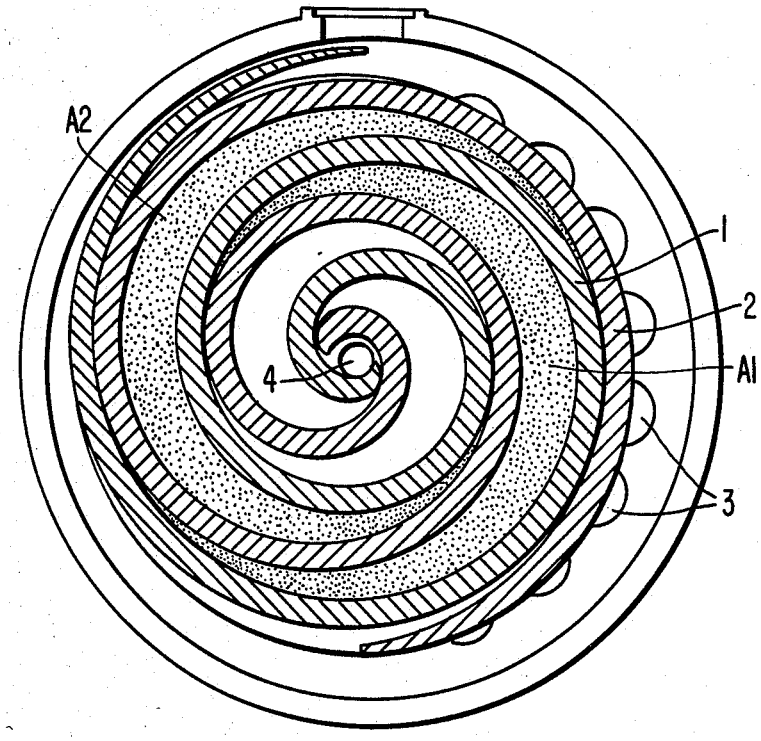
Figure 1C:
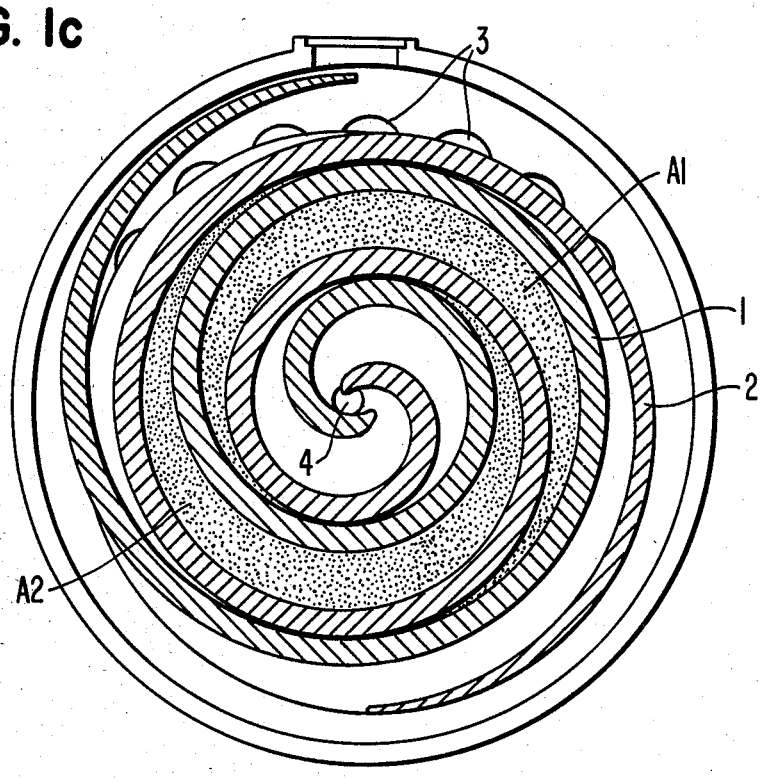
Figure 1D:
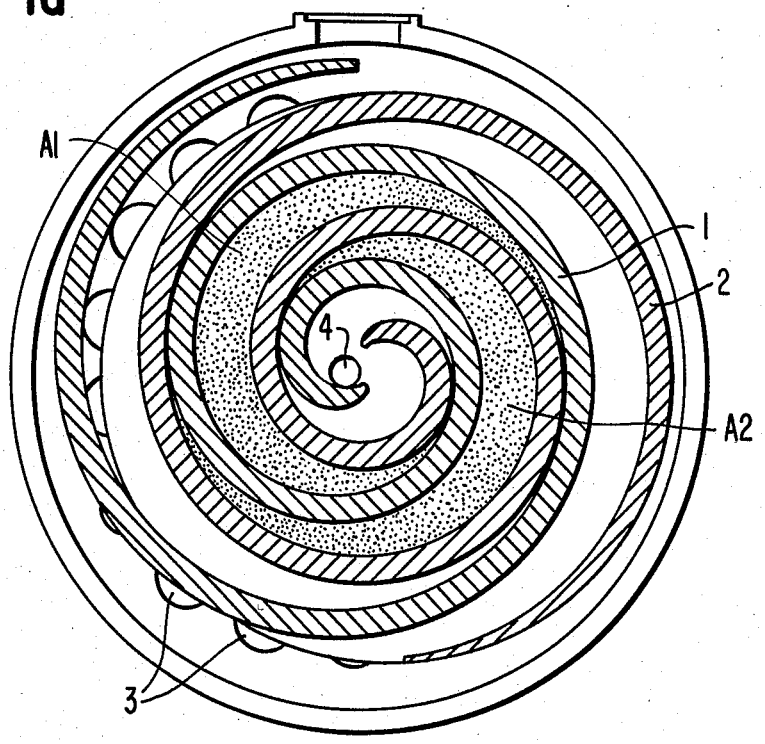
Figure 1E:
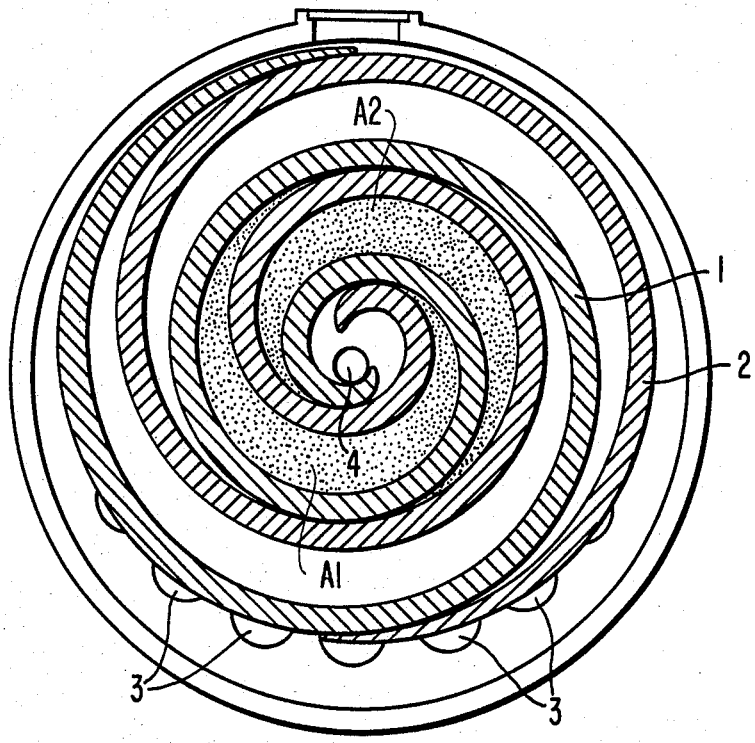
Figure 1F:
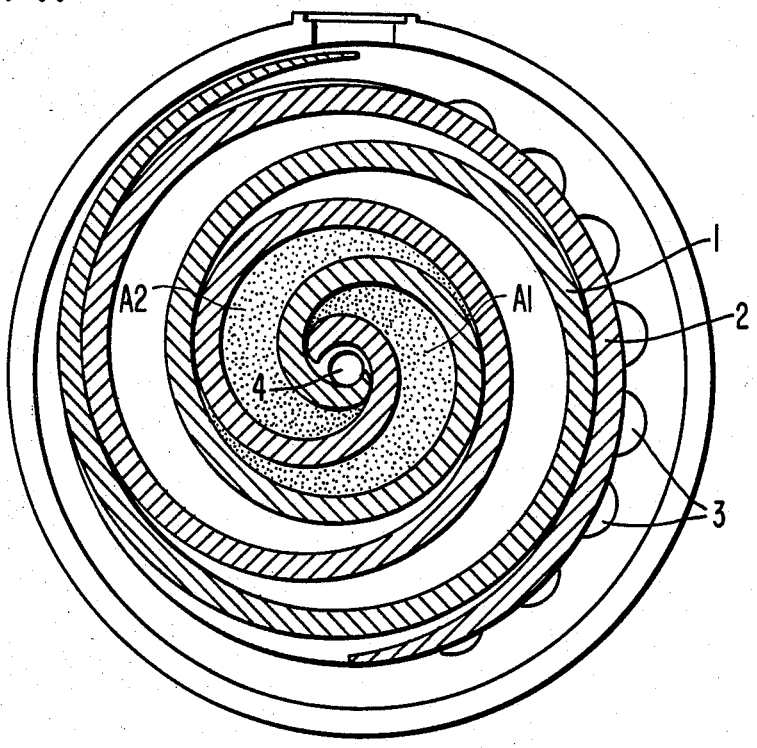
Figure 1I:
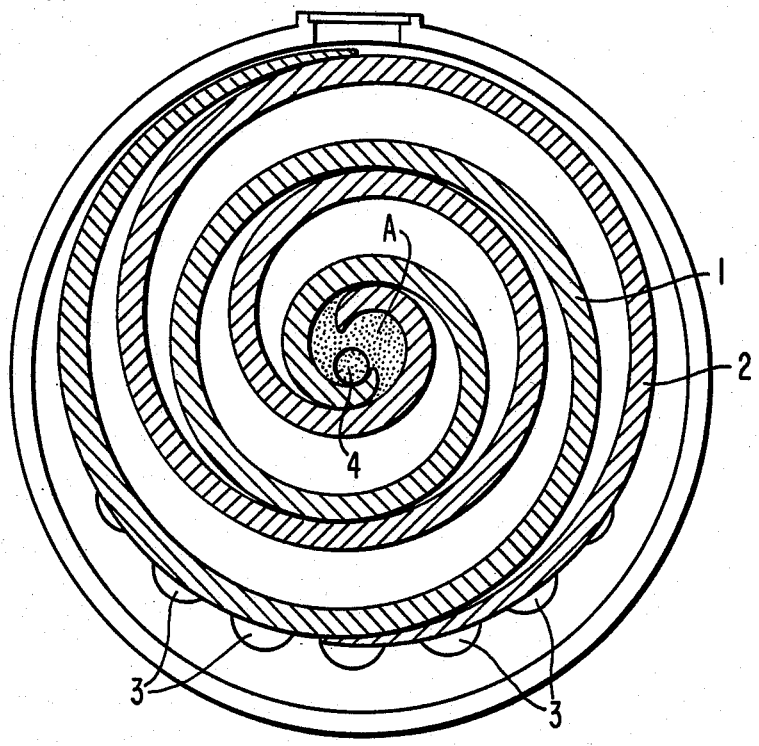
Figure 1J:
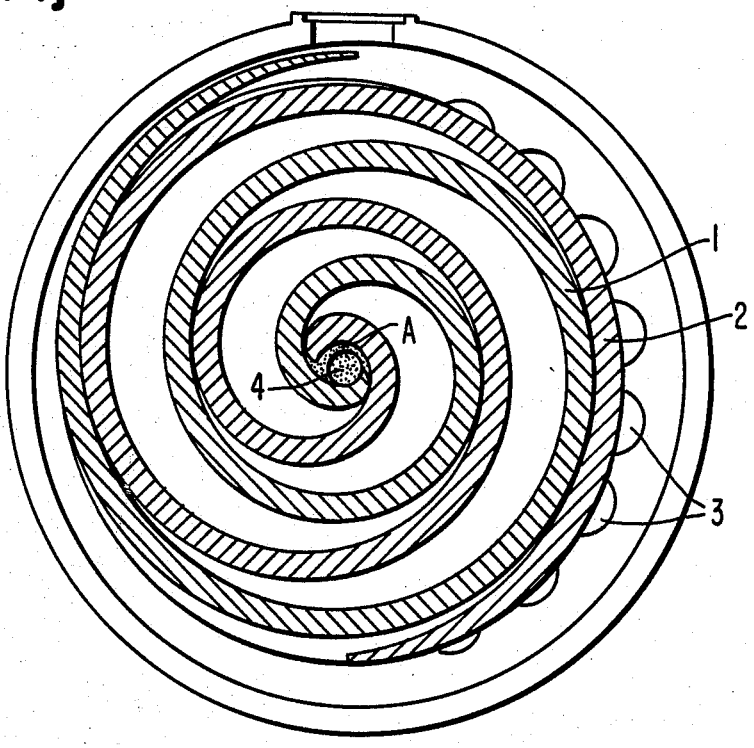
Figure 1K:
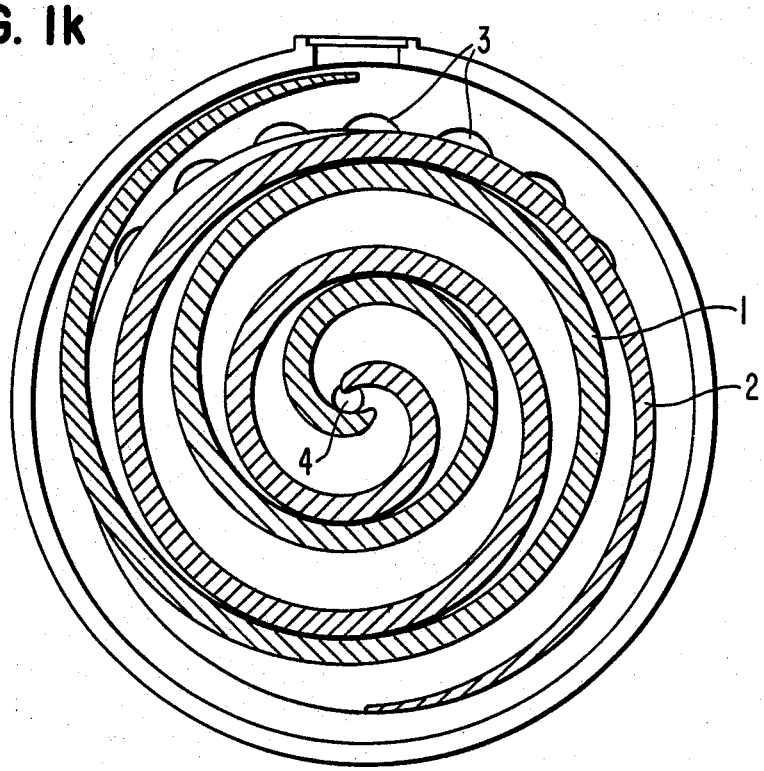
Figure 1L:
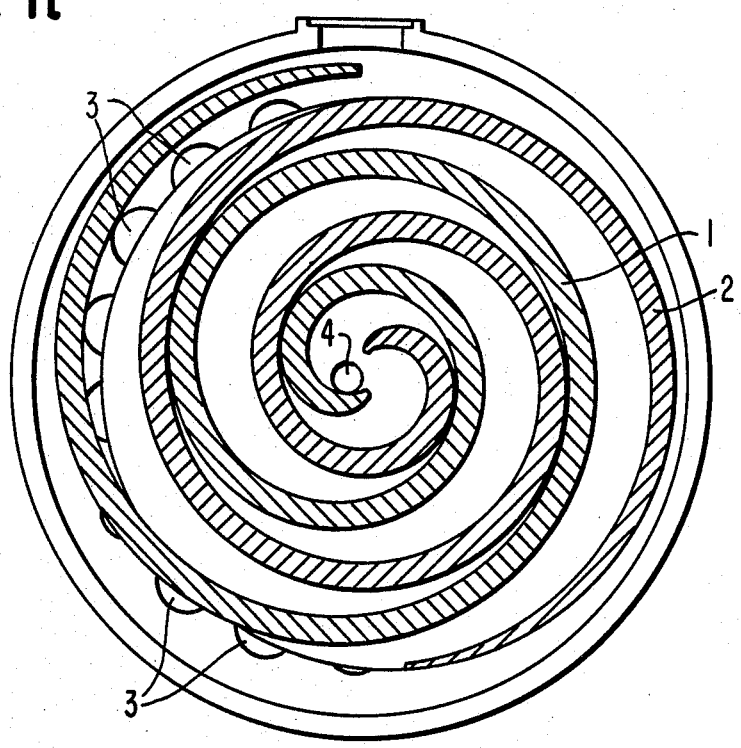
Figure 2:
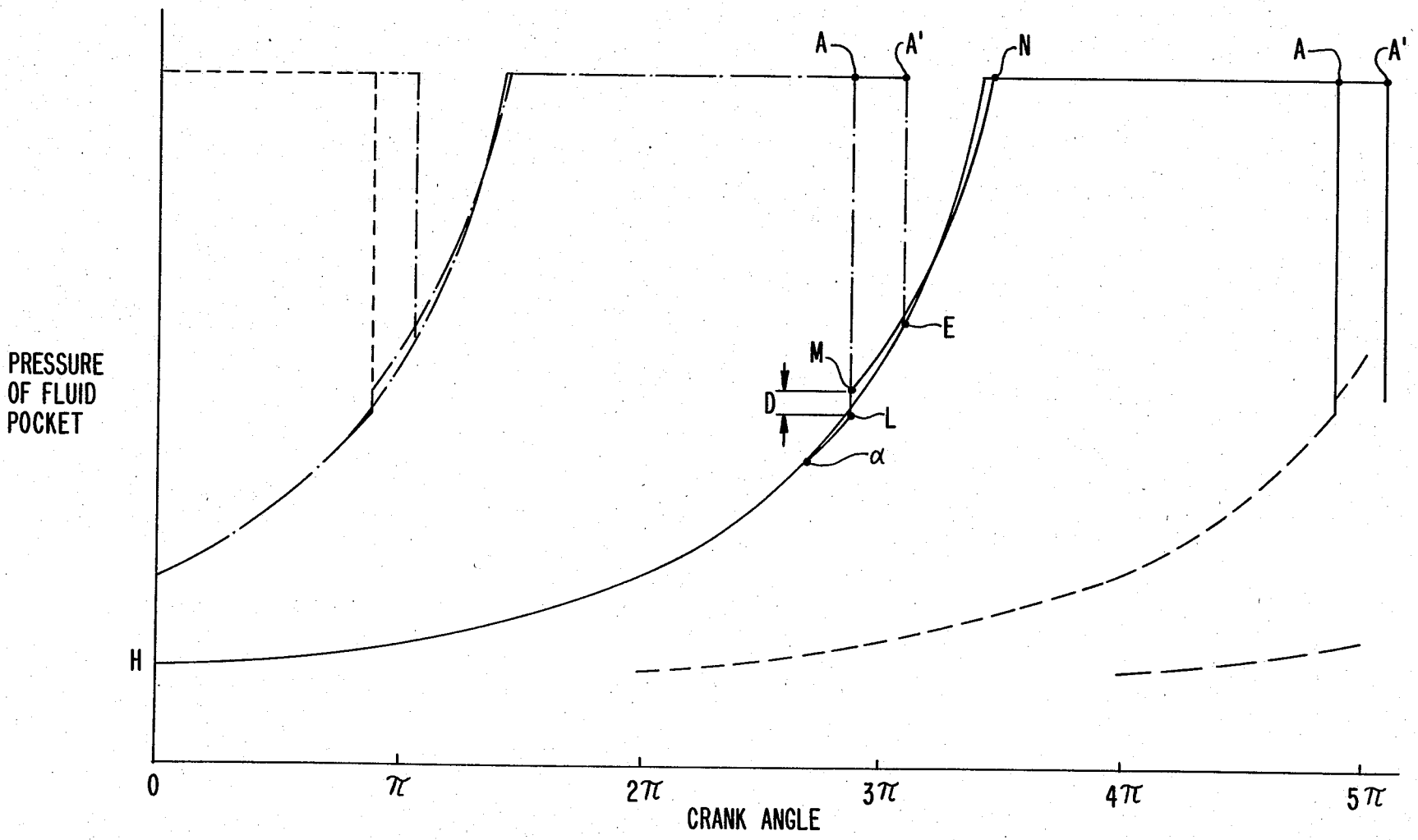
FIG. 2 is a pressure-crank angle diagram illustrating the compression cycle in each of the fluid pockets, completed at a crank angle of $5\pi$.

Referring to FIG. 2, the comprssion cycle of a compressor which includes the spiral elements according to this invention is shown by the bold line in FIG. 2. In this embodiment, the discharge stroke can be continued until the re-expansion volume reaches approximately zero; therefore, the high pressure condition of the central space is maintained until the crank angle reaches point A' of FIG. 2. Furthermore, in comparison with a prior art compressor, the pressure in the fluid pockets is only slightly increased from point L, which is the terminal point of line contacts defined by the involute curves. In the prior art compressor, when the central space is connected with the outer fluid pockets, the pressure in the fluid pockets is suddenly raised by a greater amount D. However, since in the inventive compressor the central space is connected with the outer fluid pockets at point E, and the volume of the central pocket becomes approximately zero, the pressure in the central fluid pocket is gradually increased, resulting in less recompression and greater efficiency.

This invention has been described in detail in connection with preferred embodiments. However, this description is for purposes of illustration only. It will be understood by those skilled in the art that other variations and modifications can be easily made within the scope of this invention, which is limited only by the following claims.

We claim:

1. In a scroll type fluid compressor including a housing having a fluid inlet port and a fluid outlet port, a fixed scroll fixedly disposed relative to said housing and having a circular end plate from which a first spiral wrap extends axially into the interior of said housing, an orbiting scroll movably disposed for non-rotative orbital movement at a substantially constant orbital radius within the interior of said housing and having a circular end plate from which a second spiral wrap extends, said first and second wraps defined in part by inner and outer involute side wall surfaces and interfitting at an angular and radial offset to make a plurality of line contacts to define at least one pair of sealed off fluid pockets, drive means operatively connected to said orbiting scroll to effect the orbital motion of said orbiting scroll while preventing rotation of said orbiting scroll, thus causing the fluid pockets to diminish in volume due to the orbital motion of said orbiting scroll, the fluid pockets eventually merging to form a single high pressure pocket generally at the center of the scrolls and adjacent the fluid output port, the improvement wherein the involute curve which forms the outer side wall surface of each of said wraps starts from an arbitrary involute angle, the involute curve which forms the inner side wall surface of each of said wraps starts at an involute angle which is 180° greater than said arbitrary involute angle, and said starting points are interconnected by an inner end surface comprised of at least two arcuate surfaces to form a thicker inner end portion of said wrap, whereby the inner end portion of each wrap is strengthened and the innermost line contact defining the central high pressure pocket moves further inwardly toward the center of said wraps to minimize reexpansion of the compressed fluid back into the adjacent pair of fluid pockets.

2. A compressor according to claim 1 wherein the radius of the arcuate surface adjacent said inner side wall surface exceeds the radius of the arcuate surface adjacent said outer side wall surface substantially by said orbital radius.

3. A compressor according to claim 1 wherein said inner end surface consists only of said two arcuate surfaces.

4. A compressor according to claim 3 wherein the radius of the arcuate surface adjacent said inner side wall surface exceeds the radius of the arcuate surface adjacent said outer side wall surface substantially by said orbital radius.

5. A compressor according to claim 1 wherein said inner end surface is comprised of said two arcuate surfaces and a flat surface which interconnects said two arcuate surfaces.

6. A compressor according to claim 5 wherein the radius of the arcuate surface adjacent said inner side wall surface exceeds the radius of the arcuate surface adjacent said outer side wall surface substantially by said orbital radius.

7. A compressor according to claim 5 wherein said inner end surface consists only of said two arcuate surfaces and said flat surface.

8. A compressor according to claim 7 wherein the radius of the arcuate surface adjacent said inner side wall surface exceeds the radius of the arcuate surface adjacent said outer side wall surface substantially by said orbital radius.

* * * * *